United States Patent [19]

Kawamura

[11] Patent Number: 4,810,216

[45] Date of Patent: Mar. 7, 1989

[54] REMOTE CONTROL SYSTEM FOR MARINE ENGINE

[75] Inventor: Minoru Kawamura, Iwata, Japan

[73] Assignee: Sanshin Kogyo Kabushiki Kaisha, Shizuoka, Japan

[21] Appl. No.: 129,851

[22] Filed: Dec. 7, 1987

Related U.S. Application Data

[63] Continuation-in-part of Ser. No. 53,521, May 19, 1987, abandoned, which is a continuation of Ser. No. 818,799, Jan. 14, 1986, abandoned.

[30] Foreign Application Priority Data

Jan. 14, 1985 [JP] Japan ..... 60-4266
Jan. 14, 1985 [JP] Japan ..... 60-4267

[51] Int. Cl.[4] ..... B63H 21/21

[52] U.S. Cl. ..... 440/2; 440/84; 455/603

[58] Field of Search ..... 114/144 A, 144 E; 440/1, 2, 7, 84, 113; 180/2.1, 315, 335, 336; 350/96.1, 96.16; 455/603, 59

[56] References Cited

U.S. PATENT DOCUMENTS

| | | | |
|---|---|---|---|
| 3,121,415 | 2/1964 | Anderson et al. | 440/59 |
| 4,191,270 | 3/1980 | Monteith | 180/315 X |
| 4,276,656 | 6/1981 | Petyk, Jr. | 350/96.16 X |
| 4,306,314 | 12/1981 | Griffiths | 455/603 |
| 4,344,065 | 8/1982 | Erwin et al. | 114/144 E |
| 4,563,162 | 1/1986 | Ishimoto | 455/603 X |
| 4,565,529 | 1/1986 | Aertker et al. | 440/7 |
| 4,739,236 | 4/1988 | Burkenpas | 450/1 X |

FOREIGN PATENT DOCUMENTS

| | | |
|---|---|---|
| 163093 | 7/1986 | Japan . |
| 163094 | 7/1986 | Japan . |

*Primary Examiner*—Sherman D. Basinger
*Attorney, Agent, or Firm*—Ernest A. Beutler

[57] ABSTRACT

A remote control device for an outboard motor including a remotely positioned controller device that operates control devices carried by the outboard motor through optical fiber transmitted signals. The optical fibers are detachably connected to the controllers so as to permit removal of the controller. In addition, the controller is detachably supported within the associated watercraft so that it may be conveniently removed.

8 Claims, 4 Drawing Sheets

Fig-1
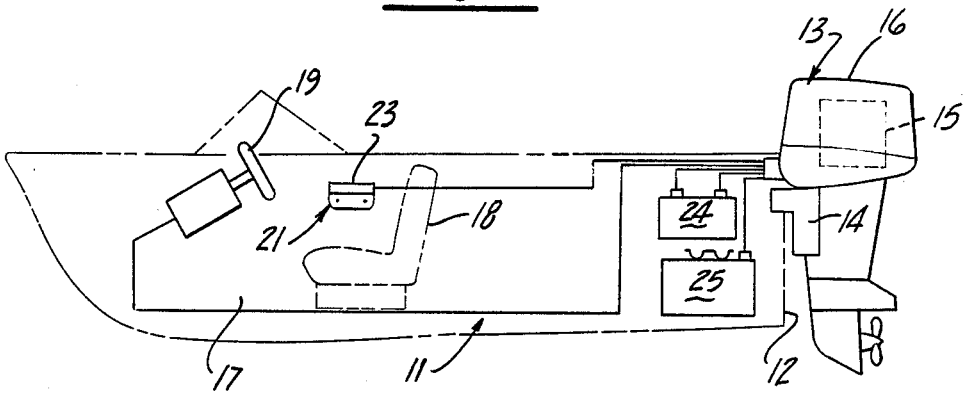
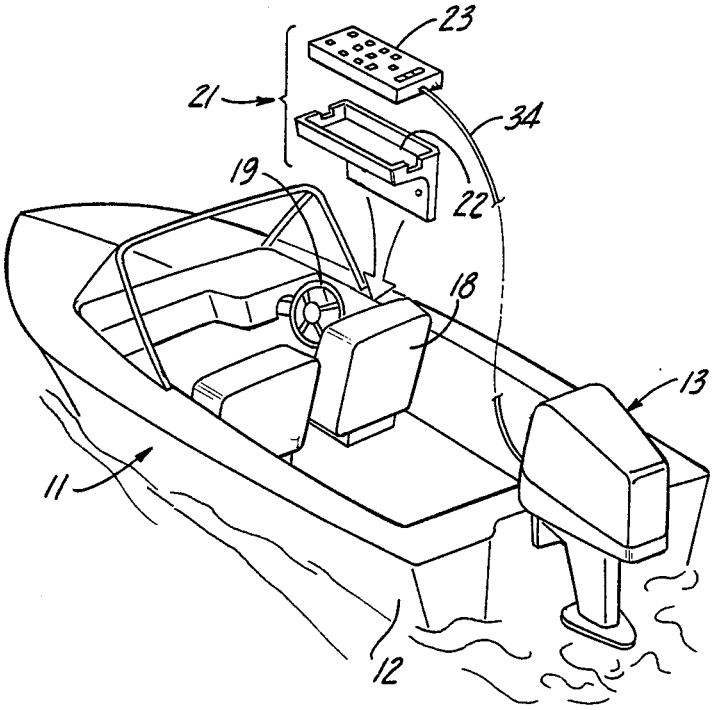
Fig-2

REMOTE CONTROL SYSTEM FOR MARINE ENGINE

CROSS REFERENCE TO RELATED APPLICATIONS

This application is a continuation-in-part of my application of the same title, Ser. No. 053,521, filed May 19, 1987, and now abandoned, which application is a continuation of the application of the same title, Ser. No., 818,799, filed Jan. 14, 1986 and now abandoned.

BACKGROUND OF THE INVENTION

This invention relates to a remote control system for a marine engine and more particularly to an improved, simplified and versatile remote control device for a marine engine.

In many types of marine applications, the engine is positioned at a remote distance from the boat operator. For example, it is the common practice to provide many types of water craft with a forwardly positioned steering wheel and operator location while the boat may be powered by one or more outboard motors mounted on the transom. With such remote locations, it is necessary to provide some means for interconnecting the individual controls of the outboard motor to the operator. For example, the outboard motor may employ an electrical starter, a throttle control mechanism, and a shifting mechanism, all of which should be operable from the remotely positioned operator location. Conventionally it has been the practice to provide flexible transmitters and associated linkage systems for permitting the operator to control the starting, throttle and shifting functions of the outboard motor from his remote position. However, the use of flexible transmitter and linkage systems provide a number of disadvantages. First, the remote control mechanism must be tailored to the particular water craft and engine and hence cannot be versatile so as to permit utilization with a wide variety of water craft and outboard motors. In addition, the flexible transmitters can bind up in operation and render the controls difficult or impossible to operate satisfactorily. These disadvantages are particularly true when operating in marine environments. Finally, the control mechanism must form a relatively permanent part of the water craft and thus must be left in the water craft when it is not being utilized.

In addition to the basic starting, throttle and shifting controls aforedescribed, it is also desirable if the outboard motor can be provided with a number of ancillary controls. For example, it is desirable if many operating conditions of the motor such as engine speed, temperature, lack of lubricant and trim condition can be controlled and/or displayed at the operator control. In addition, certain additional engine control features such as a kil switch, emergency acceleration and deceleration controls and various trim adjustments are desirable from the operator's remote location. The previously proposed mechanical systems for achieving these controls and/or transmitting the signals to the remotely positioned operator from the transom mounted outboard motor simply have not been satisfactory.

In connection with the use of remote control operators, it is desirable if the owner of the watercraft can remove the remote control device from the watercraft so as to render the watercraft unusable. This provides good anti-theft protection. In connection with the removal of the remote control device, it is very desirable if the remote control device from one watercraft will not be usable with a similar unit of another watercraft. That is, it is desirable if the control device can be coded relative to the controlled device so that only a matched pair can be used and the owner of one remote control device cannot operate the watercraft of another using a similar system.

It is, therefore, a principal object of this invention to provide an improved remote control device for a marine engine.

It is a further object of this invention to provide a remote control device for a marine engine that does not rely upon mechanical motion transmitting devices.

It is a yet further object of this invention to provide an improved remote control device for a marine engine that is adaptable to a number of different types of engines and water craft and which may be easily removed from the water craft when not in use.

It is a still further object of this invention to provide an improved remote control device for a marine engine that permits a wider latitude of controlled conditions than those previously provided.

It is yet another object of this invention to provide an improved remote control device for a marine engine that is adaptable to a number of different types of engines and watercraft and which an be encoded so that anti-theft protection is provided.

SUMMARY OF THE INVENTION

This invention is adapted to be embodied in a remote control mechanism for a marine outboard drive comprising a spark ignited internal combustion engine and having a control element moveable between at least two different positions for effecting a control of the outboard drive. A remotely positioned controller is adapted to be placed remotely from the outboard drive and in proximity to an operator. A controller element is carried by the remotely positioned controller. Drive means are provided for operating the control element between its positions and control means transmit a optical fiber signal nonmechanically from the controller element to the drive means for operating the drive means to actuate the control element upon operator actuation of the controller element, the remotely positioned controller includes an encoding device for encoding signals to optial signals for transmission by the optical fiber means and a detachable connection is provided between the controller and the optical fiber means.

BRIEF DESCRIPTION OF THE DRAWINGS

FIG. 1 is a partially schematic side elevational view of a marine drive embodying the invention.

FIG. 2 is a partially exploded perspective view showing the controller element.

DETAILED DESCRIPTION OF THE PREFERRED EMBODIMENT OF THE INVENTION

Figure 3:
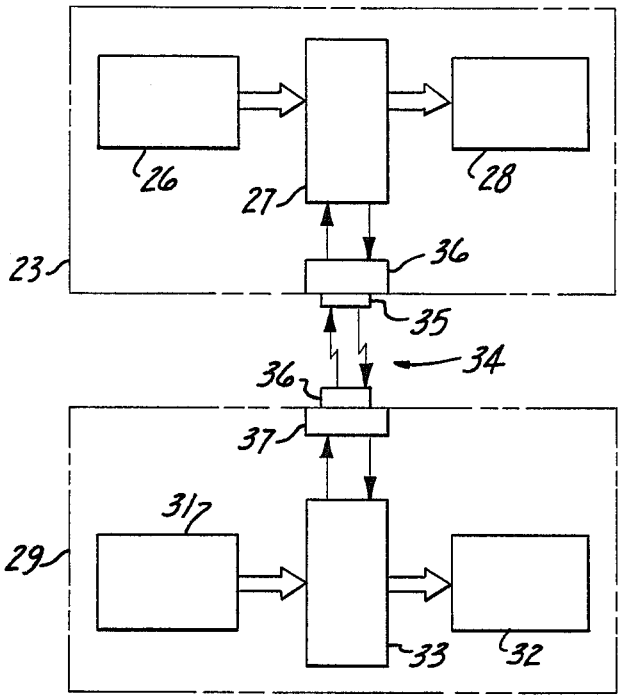
FIG. 3 is a schematic of the device.

Referring first to FIGS. 1 and 2, a marine water craft is identified generally by the reference numeral 11 and has a transom 12 on which an outboard, indicated generally by the reference numeral 13, is supported in a conventional manner by means including a swivel bracket 14. The outboard motor 13 includes a powering internal combustion engine 15 that is surrounded within a protective cowling 16 to form the power head of the outboard motor 13.

The boat 11 also has a passenger compartment area 17 including at least one seat 18 that is positioned remotely from the transom 12 and the outboard motor 13. An operator can sit on the seat 18 and steer the outboard motor 13 by means of a steering wheel 19 and interconnecting steering mechanism, which may be of any known type. Positioned in proximity to the steering wheel 19 is a controller console 21 that is formed with a cavity 22 into which a controller box 23 may be conveniently installed and removed. The controller box 23, as will become apparent, contains a number of devices and systems for controlling certain aspects of the operation of the outboard motor 13 as well as providing an indication of certain operating conditions of the motor 13 to the operator.

Adjacent the transom 12 the water craft 11 is provided with a compartment wherein a battery 24 may be housed for supplying electrical power to the outboard motor 13 and controller 23. In addition, a fuel tank 25 may be positioned in the same area for supplying fuel to the engine 15 of the outboard motor 13. Furthermore, if the outboard motor 13 is provided with a separate lubrication system, a lubricant storage tank (not shown) may be positioned within this area of the water craft 11.

Referring now to the remaining figures, the manner of providing the remote control for the various functions of the outboard motor 13 will be described. The system is shown schematically in FIG. 3 wherein the control box 23 is depicted as being comprised of a control instruction input part 26 which, as will become apparent, can provide a number of control input functions. These functions are transmitted to a central processing unit 27 in the form of a mini or micro computer. In addition, there is provided an operating state display 28 for displaying certain operating conditions as will also become apparent.

A controlled device, indicated generally by the reference numeral 29, is provided that is mounted in proximity to or as a part of the outboard motor 13. This device 29 includes a number of sensors 31 and one or more control actuating devices 32 each of which transmit signals to or receive signals from a central processing unit 33. Signals are transmitted between the processing units 27 of the controller 23 and 33 of the controlled device 29 by means of fiber optical transmitters 34. The transmitters 34 are connected by means of respective coupling devices 35 and 36 to the controller device 23 and the controlled device 29. The signals from the central processing units 27 and 23 are transmitted into optical signals by means of photoelectric conversion units 36 and 37, respectively, which are contained within the controller device 23 and the controlled device 29 and may be specially encoded as that the controller device, and the controlled device 29 are specially keyed to each other for anti-theft protection.

Figure 4:
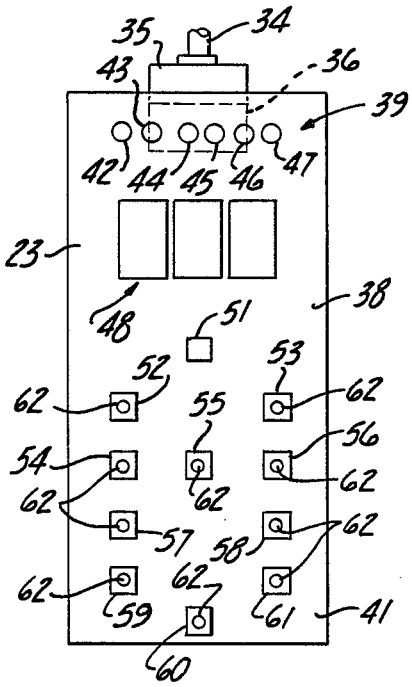
FIG. 4 is a top plan view showing the controller element.

The physical configuration of the controller device 23 may be best understood by FIG. 4 wherein the device 23 is illustrated in elevation. Device 23 comprises a panel facing 38 having a first area 39 that comprises a display area and a second area 41 that comprises a combined control and display area. The display area contains a number of light emitting diodes (LED) that indicate various conditions of both the controlled unit and the engine running condition. This may include an LED 42 for indicating that the power for the remote control is operative, an LED 43 for indicating that the kill switch is on so that the engine should not be running, an LED 44 for indicating that the central processing unit of the controller device 23 is malfunctioned, an LED 45 for indicating engine overheating, an LED 46 for indicating engine overspeed and an LED 47 for indicating lack of lubricating oil for the engine. In addition, a number of LEDs for giving numerical readout of engine speed 48 are positioned below the array of LEDs 42 through 47.

Control panel portion 41 includes a number of switches (which may be either mechanical or capacitive type) for controlling a number of functions. These may include a kill switch 51, an emergency accelerating switch 52, an emergency decelerating switch 53, a normal accelerating switch 54, a normal decelerating switch 55, a reverse transmission selector switch 56, a neutral transmission selector switch 57, a forward transmission selector switch 60, a choke actuating switch 58, a trim up control switch 59 and a trim down control switch 61. Certain of these switches may also include integral LEDs 62 for indicating when the individual switch is in operation.

Figure 5:
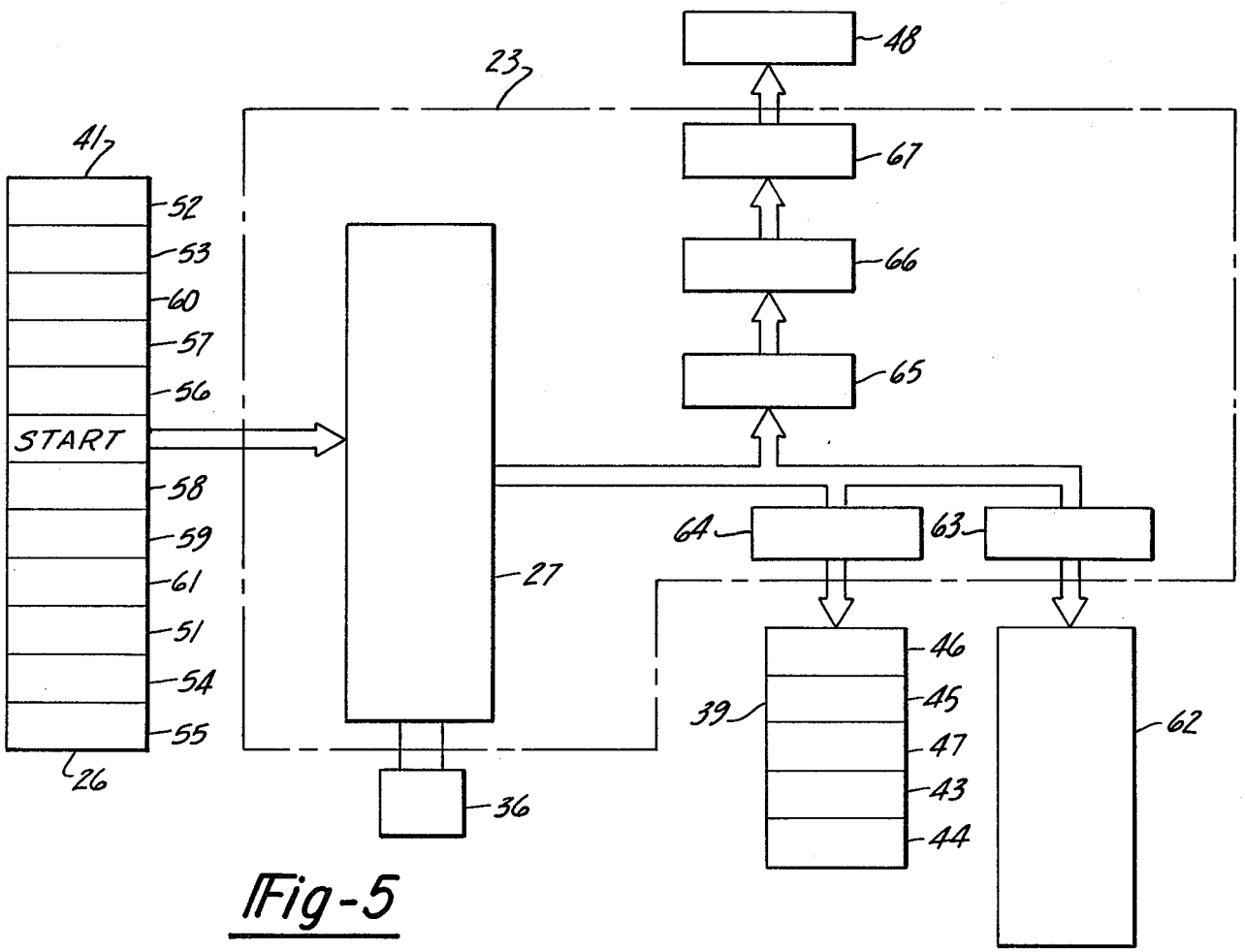
FIG. 5 is a schematic showing the functioning of the controller element.

The manner in which the controller device 23 operates may be best understood by reference to the schematic diagram of FIG. 5. The input controlling elements carried on the panel 41 are identified by the same reference numerals as the respective switches in FIG. 4 so as to illustrate the respective input control signals. In addition, there is provided a start switch which is located other than on the face 38 of the controller device 23. This different location is chosen so that the engine starter control is not inadvertently operated during engine running.

The signals from the switches 51 through 61 and the starter switch are transmitted to the central processing unit (CPU) 27 for processing in its preprogrammed manner. These signals are transmitted from electrical signals to specially encoded optical signals by the device 36 for transmission through the optical fibers 34.

The CPU 27 transmits a signal from certain of the switches 51 through 61 to a latching circuit, indicated schematically at 63, for illuminating the LEDs associated with the respective switches having these illuminations and these LED equipped switches are indicated by the box 62 in FIG. 5.

Warning indicator lights 42 through 47 are also controlled by the CPU 27. When a warning signal is transmitted to the CPU through the optical fibers 34 and optical to an encoded electrical signal converter 36, a suitable latching circuit, indicated schematically by the box 64, will provide a signal to the respective LEDs 42 through 47 to illuminate them on the portion 39 of the panel. These respective LEDs are indicated by the numerals corresponding to those used in FIG. 4 in the schematic illustration of FIG. 5. The engine speed or tachometer indicator 48 is also illuminated under the control of the CPU 27 from the optical signals received and converted by the converter 36. For this purpose, the CPU 27 operates a circuit 65 that provides a signal to a decoder 66 which, in turn, provides its output to a display driving circuit 67 so as to appropriately illuminate the LEDs of the engine speed indicator 48.

Figure 6:
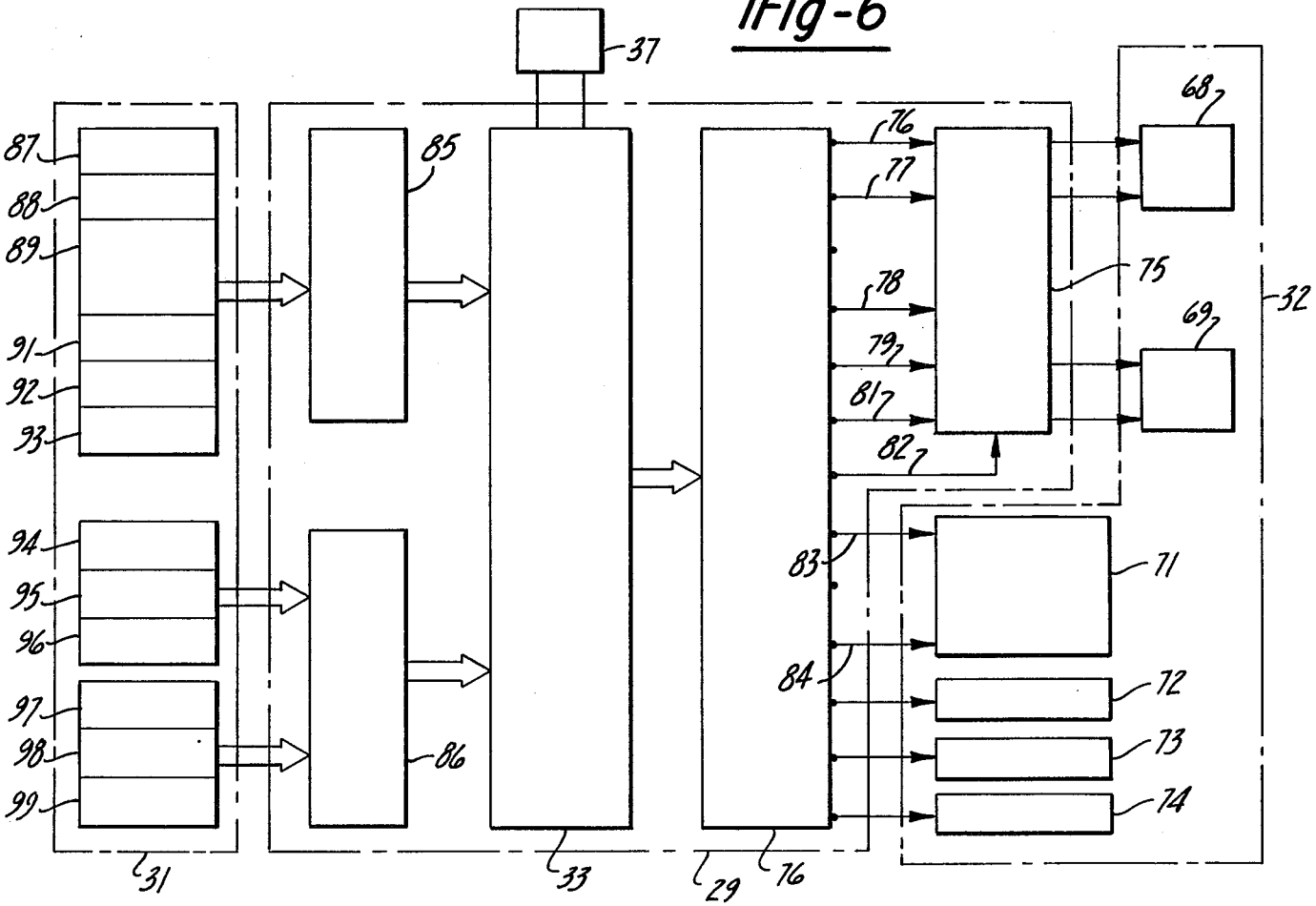
FIG. 6 is a schematic view showing the functioning of the controlled element.

Referring now to FIG. 6, the construction and operation of the controlled device will be described in connection with the schematic. The controlled device includes a stepping motor 68 that is operative to position the throttle valve of the engine 15 of the outboard motor 13. In addition, there is provided a stepping motor 69 for controlling the forward neutral reverse transmission of the lower unit of the outboard motor 13. A stepping motor 71 is provided for controlling the tilt and trim of the outboard motor 13 through an appropriate tilt and trim control mechanism which may be of any known type. A relay 72 is provided for killing the electrical circuit of the ignition of the engine for stopping. The starter motor is illustrated schematically at 73 and a stepping or solenoid control for the choke valve is indicated at 74.

The stepping motors 68 and 69 are each controlled by means of an electrical controller 75 that receives appropriate signals from a buffer circuit 76 which, in turn, receives programmed control signals from the CPU 33. Signals are indicated schematically in FIG. 6 and comprise a throttle valve opening control signal 76, a throttle valve closing control signal 77, a forward shift signal 78, a neutral shift control signal 79 and a reverse shift control signal 81. An emergency accelerate or decelerate signal 82 may also be transmitted.

The control signals to the tilt and trim drive control 71 are indicated as a tilt up control signal 83 and a tilt down control signal 84.

The engine condition indicators 31 transmit respective signals to inverters 85 or 86 for transmission to the CPU 33. These condition indicators are indicated by blocks and comprise a throttle valve opening indicator 87, a throttle valve closing indicator 88 and an indicator for limiting the speed of the engine because the transmission is in reverse 89. In addition, there are transmission position indicators comprising a forward indicator 91, a neutral indicator 92 and a reverse indicator 93.

The signals from the indicators 87 through 89 and 91 through 93 are transmitted to the inverter 85. In addition, there are certain warning indicators consisting of the overspeed indicator 94, overheating indicator 95 and low oil indicator 96 that transmit their control signals to the inverter 86.

The choke valve position indicator 97, starter-operating indicator 98 and engine speed signal 99 are also transmitted to the inverter 86.

The signals transmitted to the CPU 33 from the inverters 85 and 86 are processed by the buffer circuit 76 where necessary and transmitted to the control devices and also transmitted back through the encoded electrical to optical converters 37 for transmission to the control device 23. It should be noted that the transmissions over the optical transmitter 34 may be controlled continuously by providing a plurality of fibers for each condition or may be done in a multiplexing manner by suitably programming the CPUs 27 and 33. In addition, various additional types of control signals and control functions may be provided as are employed in this art.

It should be readily apparent from the foregoing description that a very effective remote control mechanism has been illustrated that may be utilized to transmit control signals from a controller device to a controlled device and which can be adapted to a wide variety of water craft and functions. In addition, the controller device 23 may be easily disassembled and removed from the water craft 11 when not in use for safety purposes and because of the special encoding anti-theft protection is insured.

Although an embodiment of the invention has been illustrated and described and certain other modifications have been described, additional changes and modifications may be made without departing from the spirit and scope of the invention, as defined by the appended claims.

I claim:

1. A system for anti-theft protection in a remote control mechanism for a marine outboard drive comprising a spark-ignited internal combustion engine and having a control element moveable between at least two different positions for effecting a control of said outboard drive, a remotely positioned controller adapted to be positioned remotely from said outboard drive and in proximity to an operator, a controller element carried by said remotely positioned controller and selected from one of a group of similar controller elements, drive means for operating said control element between its positions, optical fiber means for transmitting a control signal nonmechanically from said controller element and to said drive means for operating said drive means to actuate said control element upon operator actuation of said controller element, and means for detachably connecting said optical fiber means to one of said controller elements and said drive means, and unique encoding means for each of the group of similar controller elements for converting input signals from said controller element to unique optical signals for transmission by said optical fiber means and for converting optical signals transmitted from said optical fiber means to signals for operating said drive means.

2. A remote control mechanism as set forth in claim 1 wherein the means for transmitting the control signal comprises an electrical to optical converter for transmitting electrical signals to optical signals and optical signals to electrical signals.

3. A remote control mechanism as set forth in claim 2 wherein the electrical to optical converters are detachably connected to the respective controller and controlled devices.

4. A remote control mechanism as set forth in claim 1 wherein there are a plurality of control elements each operated by respective drive means and the remotely positioned controller includes a plurality of controller elements, one for each of said drive means.

5. A remote control mechanism as set forth in claim 4 further including condition indicators associated with the remotely positioned controller for indicating the condition of certain functions of the outboard drive.

6. A remote control mechanism as set forth in claim 5 wherein the means for transmitting the control signal comprises an electrical to optical converter for transmitting electrical signals to optical signals and optical signals to electrical signals.

7. A remote control mechanism as set forth in claim 6 wherein the electrical to optical converters are detachably connected to the respective controller and controlled devices.

8. A remote control mechanism as set forth in claim 7 in combination with a water craft having a console positioned in proximity to the operator and adapted to detachably support the controller for removal of said controller from the water craft upon detachable connection of said controller from said optical fiber means.

* * * * *